US007448517B2

(12) United States Patent
Shieh et al.

(10) Patent No.: US 7,448,517 B2
(45) Date of Patent: Nov. 11, 2008

(54) COMPRESSED GAS PROPELLANTS IN PLASTIC AEROSOLS

(75) Inventors: Doris S. Shieh, Santa Clara, CA (US); Daniel A. Huitt, Esparto, CA (US); Timothy James Kennedy, Pleasanton, CA (US); Ricardo Ruiz De Gopegui, Dublin, CA (US)

(73) Assignee: The Clorox Company, Oakland, CA (US)

( * ) Notice: Subject to any disclaimer, the term of this patent is extended or adjusted under 35 U.S.C. 154(b) by 261 days.

(21) Appl. No.: 11/421,302

(22) Filed: May 31, 2006

(65) Prior Publication Data

US 2008/0017671 A1 Jan. 24, 2008

(51) Int. Cl.
*B65D 83/00* (2006.01)

(52) U.S. Cl. ..... 222/394; 222/402.1; 510/279

(58) Field of Classification Search ..... 222/394, 222/402.1, 402.22, 402.23; 510/279–280, 510/303

See application file for complete search history.

(56) References Cited

U.S. PATENT DOCUMENTS 4,230,243 A 10/1980 Spitzer et al.
5,143,288 A * 9/1992 Kohler et al. ..... 239/1
5,152,411 A 10/1992 Pope et al.
5,199,615 A 4/1993 Downing et al.
5,534,167 A * 7/1996 Billman ..... 510/280
5,553,753 A 9/1996 Abpanap
5,585,125 A 12/1996 Iizuka et al.
5,814,309 A 9/1998 Panitch
5,888,598 A 3/1999 Brewster et al.
6,045,784 A 4/2000 Ruebusch et al.
6,176,382 B1 1/2001 Bazlur Rashid
6,279,834 B1 8/2001 Fox et al.
6,390,326 B1 5/2002 Hung
6,394,364 B1 5/2002 Abplanap
6,491,187 B2 12/2002 Walters
6,702,978 B1 3/2004 Kuehn
6,884,382 B2 4/2005 Lynch et al.
2001/0045434 A1 11/2001 Tsai
2002/0150657 A1 10/2002 Farr et al.
2003/0215399 A1 11/2003 Smith et al.
2003/0215400 A1 11/2003 Schroeder et al.
2004/0144863 A1 7/2004 Kendrick et al.
2004/0144864 A1 7/2004 Valpey, III et al.
2004/0149781 A1 8/2004 Kunesh et al.
2004/0166266 A1 8/2004 de Wit
2005/0060953 A1 3/2005 Altonen et al.
2005/0214386 A1 9/2005 Shaheen et al.
2005/0227897 A1* 10/2005 Nelson et al. ..... 510/407
2005/0242101 A1 11/2005 Skaliszky
2006/0272537 A1* 12/2006 Garrett ..... 102/367

FOREIGN PATENT DOCUMENTS

GB 1341126 12/1973
WO WO97/03179 1/1997

* cited by examiner

*Primary Examiner*—Frederick C. Nicolas
(74) *Attorney, Agent, or Firm*—David Peterson

(57) ABSTRACT

Plastic aerosol containers with compressed gas propellants can be designed to deliver small particle size spray throughout the life of the aerosol device by controlling critical parameters such as headspace volume and pressure, and gas permeation through the walls of the plastic aerosol container.

18 Claims, 4 Drawing Sheets

COMPRESSED GAS PROPELLANTS IN PLASTIC AEROSOLS

BACKGROUND OF THE INVENTION

1. Field of the Invention

This invention relates to the use of compressed gas propellants with plastic aerosol containers.

2. Description of the Related Art

Pressurized containers for dispensing aerosols are well known in the art, and are typically constructed of metal in order to withstand the inherent internal pressure of aerosols. However, it is desirable to provide a plastic container capable of withstanding the internal pressures generated by an aerosol because plastic has many advantages over metal. Some of these advantages include the ease and economy of manufacture, and aesthetic appeal to an end user.

The two main types of propellants used in aerosol dispensers today are liquefied gas propellants, such as hydrocarbon and hydrofluorocarbon (HFC) propellants, and compressed gas propellants, such as compressed carbon dioxide or nitrogen gas. In an aerosol dispenser using the liquefied gas-type propellant (also known as a double phase propellant), the container is loaded with the liquid product and propellant, and pressurized to a pressure approximately equal to, or slightly greater than, the vapor pressure of the propellant. Since the container is pressurized to the vapor pressure of the propellant, a majority of the propellant is liquefied. However, a small portion of the propellant will remain in gaseous form. As the product is dispensed, the pressure within the container will decrease and more of the propellant will enter the gas phase. In a compressed gas aerosol dispenser, the propellant remains in gaseous form when the container is pressurized for use.

U.S. Pat. App. 2004/0144863 to Kendrick et al. discloses the problems involved in trying to maintain a small particle size mist over the useful life of the aerosol, using a liquefied gas propellant in a metal container where a constant pressure is maintained by the reservoir of liquefied propellant. The problems are much more difficult in plastic aerosol containers using pressurized gas, as suggested in U.S. Pat. App. 2005/0242101 to Skalitzky. Pressure in the aerosol container is proportional to the amount of compressed gas propellant (unlike liquified gas propellants which maintain constant pressure) so the amount of propellant that can be used is limited. Also, compressed gas propellants permeate through plastic containers. The low usage level and permeation combine to limit the shelf life of the aerosol and may require upgraded resin or other costly bottle enhancements to have an acceptable shelf life. Finally, with compressed gas propellant, the pressure in the aerosol container drops as the product is used. This results in changing spray performance as the product is used and limits the utility of plastic aerosol containers using compressed gas propellants.

The problems with compressed gas propellants in plastic aerosol containers can be avoided by recognizing the criticality of the relationship among the particle size requirements, headspace volume and pressure, and gas permeation through the walls of the plastic aerosol container.

SUMMARY OF THE INVENTION

Figure 1:
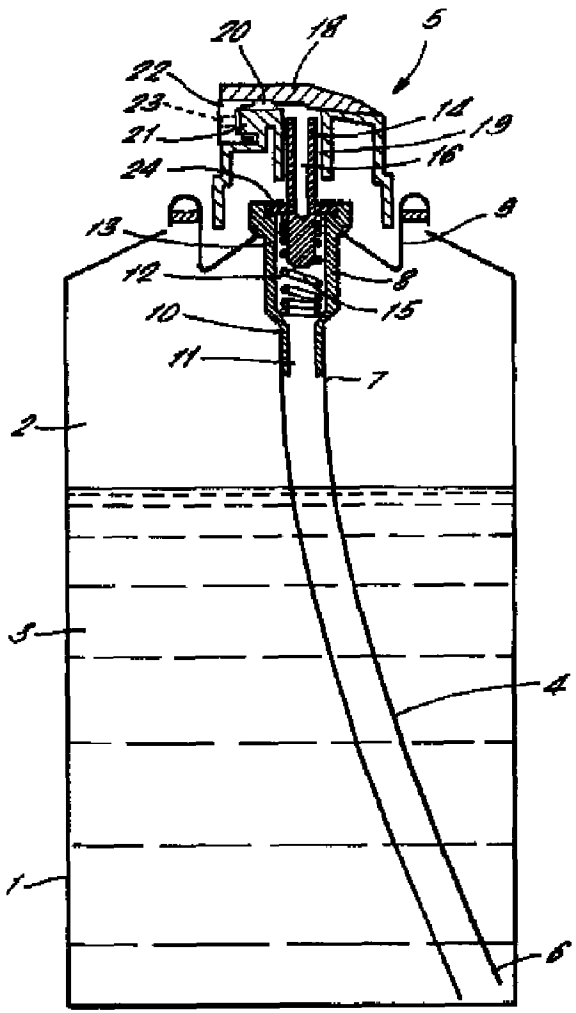
FIG. 1 is an aerosol container.

In accordance with the above objects and those that will be mentioned and will become apparent below, one aspect of the present invention comprises an aerosol device comprising:

a. a plastic container having an actuator, a valve, and containing an aerosol product composition comprising:
   i. an aqueous composition;
   ii. a compressed gas propellant selected from the group consisting of oxygen, air, nitrogen and combinations thereof, b. wherein the container has an oxygen transfer rate of less than 0.2 cc/(package*day) at 23° C;

c. wherein the container has an initial headspace of greater than 40%;

d. wherein the aerosol spray has an average initial particle size of greater than 40 μm and less than 100 μm; and e. wherein the container has an initial pressure of greater than 75 psi.

In accordance with the above objects and those that will be mentioned and will become apparent below, another aspect of the present invention comprises an aerosol device comprising:

a. a plastic container having an actuator, a valve, and containing an aerosol product composition comprising:
   i. an aerosol composition; and
   ii. a compressed gas propellant selected from the group consisting of oxygen, air, nitrogen and combinations thereof, b. wherein the dispensed product has an average particle size of less than 100 μm over at least 75% of the life of aerosol device.

In accordance with the above objects and those that will be mentioned and will become apparent below, another aspect of the present invention comprises an aerosol device comprising:

a. a plastic container having an actuator, a valve, and containing an aerosol product composition comprising:
   i. an aqueous composition;
   ii. a compressed gas propellant selected from the group consisting of oxygen, air, nitrogen and combinations thereof;

b. wherein the container has an initial headspace of greater than 40%; and c. wherein the aerosol spray has an average initial particle size of less than 100 μm.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, cationic and/or amphoteric agents.

The aerosol composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

As used herein, the term "microbiological contaminants" refers to any microbial contaminant. Example of microbiological contaminants include, but are not limited to, fungi, bacteria, viruses, Protista, and molds, including mold spores. Examples of such microbiological contaminants include *Stachybotrys Chartarum, Aspergillus niger, Absidia* sp., *Acrodorticm salmoneum, Aspergillus candies*, anthrax, etc. In one aspect, the present invention provides a method for remediating a microbiological contaminant. The method generally includes the step of exposing a microbiological contaminant to the aerosol spray. The microbiological contaminants can include a mold, mildew, a bacterium, a fungus and/or a virus, e.g *Aspergillus-niger, stachybotrys*, and penicillin *digitatum* . The remediation encompassed by the present invention can include cleaning, sanitizing, deodorizing, sterilizing, or killing target microbiological contaminants. This remediation can include killing a mold spore population and/or a mold population. The method can include remediating one or more microbiological contaminants in a bathroom, kitchen, restaurant, gym, medical facility, locker room, or aquatic facility.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "aerosol" will be understood herein to encompass both aerosols, literally, and other liquid or flowable products that can be dispensed from pressurized containers in a manner comparable to aerosolized products. Such products include but are not limited to foamed or gel preparations or to liquid products delivered in a non-aerosol stream. It is also herein contemplated that the present invention may be practiced in many consumer products including, but not limited to, cleaners, disinfectants, antiperspirants, deodorants, hairsprays, cooking sprays, beverages, perfumes, shaving creams/gels, or drug products.

The term "aerosol composition" as used herein means any composition that is pressurized from a gas and/or liquefied gas propellant, wherein the propellant provides a way for pushing or moving the composition to and/or through an application device. These aerosol products can deliver the composition to its targeted source (e.g., hard surface, air, consumers skin, hair, underarm, etc.) in various ways including, but not limited to, a spray or via a porous application surface.

The term "plastic" is defined herein as any polymeric material that is capable of being shaped or molded, with or without the application of heat. Usually plastics are a homo-polymer or co-polymer that of high molecular weight. Plastics fitting this definition include, but are not limited to, polyolefins, polyesters, nylon, vinyl, acrylic, polycarbonates, polystyrene, and polyurethane.

The term "plastic aerosol container" refers to the non-refillable container vessel of the pressurized package being made substantially of plastic and fitted with a sealing valve and actuator. The sealing valve and actuator of the package may or may not necessarily be made substantially of plastic.

The term "pressurized plastic container" or "pressurized plastic package" is defined herein as a container with contents, where the contents have a pressure of at least 10 PSI greater than atmospheric pressure at 25° C.

The term "life of the aerosol device" is defined in terms of the amount of propellant within the container (i.e., the can pressure), such that the life of the aerosol device is the period between when the pressure in the container is at its maximum (100% fill weight) and when the pressure within the container is substantially depleted, i.e., equal to atmospheric pressure. It should be noted that some amount of liquid product may remain at the end of the life of the aerosol device. Thus, 75% of the life of the aerosol device represents the life over 75% of the pressure drop. As used herein, all references to pressure are taken at 70° F. (294 K), unless otherwise noted.

Propellant

A compressed gas propellant is a material that is a gas that is not in the liquid phase at 20° C. and 164.7 psia of pressure. Compressed gas propellants include nitrogen, oxygen, air, carbon dioxide, and nitrous oxide. Carbon dioxide is readily soluble in water. It has a solubility of 1.69 g $kg^{-1}$ in water at 20° C. and atmospheric pressure. Oxygen has a very limited solubility of 0.043 g $kg^{-1}$ in water at 20° C. and atmospheric pressure. Nitrogen also has a very limited solubility in water.

Aerosol Composition

The aerosol composition may contain one or more surfactants selected from nonionic, anionic, cationic, ampholytic, amphoteric and zwitterionic surfactants and mixtures thereof. A typical listing of nonionic, anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. The surfactants may be present at a level of from about 0% to 90%, or from about 0.001%

Suitable organic solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents can be present at a level of from 0.001% to 10%, or from 0.01% to 10%, or from 1% to 4% by weight.

The aerosol compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, oxidized water, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®) and/or short chain alcohols (e.g. ethanol and/or IPA). The mildewstat or bacteriostat includes, but is not limited to, mildewstats (including non-isothiazolone compounds) include Kathon GC®, a 5-chloro-2-methyl-4-isothiazolin-3-one, KATHON ICP®, a 2-methyl-4-isothiazolin-3-one, and a blend thereof, and KATHON 886®, a 5-chloro-2-methyl-4-isothiazolin-3-one, all available from Rohm and Haas Company; BRONOPOL®, a 2-bromo-2-nitropropane 1,3 diol, from Boots Company Ltd., PROXEL CRL®, a propyl-p-hydroxybenzoate, from ICI PLC; NIPASOL M®, an o-phenyl-phenol, $Na^+$ salt, from Nipa Laboratories Ltd., DOWICIDE A®, a 1,2-Benzoisothiazolin-3-one, from Dow Chemical Co., and IRGASAN DP 200®, a 2,4,4'-trichloro-2-hydroxydiphenylether, from Ciba-Geigy A.G.

The aerosol composition may include antimicrobial agents for purposes of disinfection, sanitization, sterilization, or microbiological control. Antimicrobial agents, include carboxylic acids, such as 2-hydroxycarboxylic acids, quaternary ammonium compounds, metal salts and phenolics. Non-limiting examples of these quaternary compounds include benzalkonium chlorides and/or substituted benzalkonium chlorides, di($C_6$-$C_{14}$)alkyl di-short chain ($C_{1-4}$ alkyl and/or hydroxyalkl) quaternaryammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylnzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4 -chlorophenyl biguanide) and its salts are also in this class.

The aerosol composition may include a builder or buffer, which increase the effectiveness of the surfactant. The builder or buffer can also function as a softener and/or a sequestering agent in the cleaning composition. A variety of builders or buffers can be used and they include, but are not limited to, phosphate-silicate compounds, zeolites, alkali metal, ammonium and substituted ammonium polyetates, trialkali salts of nitrilotriacetic acid, carboxylates, polycarboxylates, carbonates, bicarbonates, polyphosphates, aminopolycarboxylates, polyhydroxy-sulfonates, and starch derivatives. Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form. The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine. Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl)amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis (methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other suitable pH adjusting agents include sodium or potassium hydroxide. When employed, the builder, buffer, or pH adjusting agent comprises at least about 0.001% and typically about 0.01-5% of the aerosol composition. Suitably, the builder or buffer content is about 0.01-2%.

In one embodiment, the compositions comprise hypohalite, defined as hypohalous acid and/or salts thereof. Suitable hypohalous acids and salts may be provided by a variety of sources, including compositions that lead to the formation of positive halide ions and/or hypohalite ions, as well as compositions that are organic based sources of halides, such as chloroisocyanurates, haloamines, haloimines, haloimides and haloamides, or mixtures thereof. These compositions may also produce hypohalous acid or hypohalite species in situ. Suitable hypohalous acids and salts for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chlorosulfamide, N-chloroamines, chlorohydantoins such as dichlorodimethyl hydantoin and chlorobromo dimethylhydantoin, bromo-compounds corresponding to the chloro-compounds above, and compositions which generate the corresponding hypohalous acids, or mixtures thereof.

In one embodiment wherein the compositions herein are liquid, said hypohalite compositions is an alkali metal and/or alkaline earth metal hypochlorite, or mixtures thereof. Suitable compositions are described in U.S. Pat. App. 2005/0214386 to Shaheen et al. Compositions may be an alkali metal and/or alkaline earth metal hypochlorite selected from the group consisting of sodium hypochlorite, potassium hypochlorite, magnesium hypochlorite, lithium hypochlorite and calcium hypochlorite, and mixtures thereof. The hypohalous acids and salt composition may be an equilibrium mixture of hypochlorous acid and sodium hypochlorite. The active species is present in an amount from above zero to about 15 weight percent of the composition, or from about 0.001 weight percent (10 ppm) to about 10 weight percent of the composition, or from about 0.005 (50 ppm) to about 5 weight percent of the composition, or from about 0.005 (50 ppm) to about 0.02 (200 ppm) weight percent of the composition.

The aerosol composition may be aqueous, nonaqueous, or substantially nonaqueous. When the aerosol composition is an aqueous composition, water can be, along with the solvent, a predominant ingredient. The water can be present at a level of less than 99.9%, or less than about 99%, or less than about 98%. Additionally, the water can be present at a level of greater than 5%, greater than 50%, or less than 5%. Deionized water is preferred.

Plastic Aerosol Containers

Plastic aerosol containers are described in U.S. Pat. App. 2004/0149781 to Kunesh et al., U.S. Pat. App. 2005/0060953 to Altonen et al., 2005/0218164, U.S. Pat. App. 2003/0215400 to Schroeder et al., U.S. Pat. No. 6,390,326 to Hung, U.S. Pat. No. 5,152,411 to Pope et al., U.S. Pat. No. 6,491,187 to Walters, U.S. Pat. App. 2003/0215399 to Smith, U.S. Pat. No. 5,553,753 to Abplanalp, U.S. Pat. No. 5,199,615 to Downing et al., all of which are incorporated by reference. Suitable containers have a capacity of greater than 4 fluid ounces, or greater than 10 fluid ounces, or greater than 20 fluid ounces, or less than 1 liter. Nozzles for the aerosols may be regulated by valves, such as those available from the Precision Valve Company. In FIG. 1 of a typical aerosol container is shown the container 1, the headspace 2, and the aerosol composition 3.

The plastic container may be composed of any thermoplastic polymeric material that may be formed into the desired shape disclosed herein. Suitable polymeric materials include polyolefins such as polyethylene (PE) or polypropylene (PP) as well as polyesters such as polyethylene terephthalate (PET), nylons, polycarbonates, polyvinylchloride (PVC), and copolymer PVC. Examples of such materials include ethylene based polymers, including ethylene/vinyl acetate, ethylene acrylate, ethylene methacrylate, ethylene methyl acrylate, ethylene methyl methacrylate, ethylene vinyl acetate carbon monoxide, and ethylene N-butyl acrylate carbon monoxide, polybutene-1, high and low density polyethylene, polyethylene blends and chemically modified polyethylene, copolymers of ethylene and C1-C6 mono- or di-unsaturated monomers, polyamides, polybutadiene rubber, polyesters such as polyethylene terephthalate, polyethylene naphthalate, polybutylene terephthalate; thermoplastic polycarbonates, atactic polyalphaolefins, including atactic polypropylene, polyvinylmethylether and others; thermoplastic polyacrylamides, polyacrylonitrile, copolymers of acrylonitrile and other monomers such as butadiene styrene; polymethyl pentene, polyphenylene sulfide, aromatic polyurethanes; styrene-acrylonitrile, acrylonitrile-butadiene-styrene, styrene-butadiene rubbers, acrylontrile-butadiene-styrene elastomers, polyphenylene sulfide, A-B, A-B-A, A-$(B-A)_n$-B, $(A-B)_n$-Y block polymers wherein the A block comprises a polyvinyl aromatic block such as polystyrene, the B block comprises a rubbery midblock which can be polyisoprene, and optionally hydrogenated, such as polybutadiene, Y comprises a multivalent compound, and n is an integer of at least 3, and mixtures of said substances. The thermoplastic materials, which can be used, are generally polymers such as polyethylene (PE) or polyethylene terephthalates (PET), polyethylene glycol terephthalates or polypropylene (PP). Polyamide (PA) or ethylenevinyl alcohol (EVOH) can be used for possible further layers situated between the inner or outer edge layers. However, it is also possible to use any other plastics that are melt processable. Suitable containers can be produced from physical PET/PEN resin blends, polyethylene naphthalene (PEN) copolymers, or PEN homopolymers. Suitably, the thermoplastic polymer used to make the plastic container is a transparent, opaque, or partially opaque polymer.

The plastic container may be formed by any conventional molding technique, such as two-stage blow molding. In two-stage blow molding, a pre-form of the plastic is made by injection molding. The pre-form provides the mass of material that eventually is blown into final shape, but it also may include in substantially final form such features as the container neck and annular flange. The pre-form is reheated, enclosed within the halves of a blow mold, and thereafter expanded in such mold. Under such a process, the plastic container may be formed integrally in a one-piece construction. Blow molding techniques, as well as other techniques for manufacturing plastic containers are well known in the art.

The burst pressure (or failure pressure) of the body of the container is typically supplied by the manufacturer of the container as determined during standard testing of the container during manufacture. The minimum burst pressure is suitably greater than 100 psig, or greater than 150 psig, or greater than 200 psig, or at least 210 psig. The pressure inside the aerosol container is suitably no greater than 100 psig at 130° F., or 125 psig at 130° F., or 150 psig at 130° F., or 180 psig at 130° F.

Uses

In one aspect of the invention, the products have target uses such as hard surfaces, soft surfaces, and air. In some aspects of the invention, the products have target uses that include human and animal surfaces.

Examples of hard surfaces to which the invention can be applied include surfaces composed of refractory materials such as: glazed and unglazed tile, porcelain, ceramics as well as stone including marble, granite, and other stones surfaces; glass; metals; plastics e.g. polyester, vinyl; Fiberglas, Formica®, Corian® and other hard surfaces known to the industry. Other hard surfaces include lavatory fixtures such as shower stalls, bathtubs and bathing appliances (racks, shower doors, shower bars) toilets, bidets, wall and flooring surfaces. Further hard surfaces include painted surfaces and those associated with kitchen environments and other environments associated with food preparation, including cabinets and countertop surfaces as well as walls and floor surfaces especially those which include refractory materials, plastics, Formica®, Corian® and stone.

Examples of soft surfaces include fabrics, textiles, carpets, rugs, chairs and other furniture, draperies and the like made from natural and man-made fibers.

In one embodiment, the products can be supplied to the air in various facilities, which include but are not limited to rooms, houses, hospitals, offices, theaters, buildings, and the like, or into various vehicles such as trains, subways, automobiles, airplanes and the like.

In one embodiment, the compositions of the invention can be used for a food rinse, for cleaning food-contact surfaces, or for toxicologically safe cleaning. This may involve the use of food-safe ingredients, GRAS ingredients, or ingredients with low toxicologically impact. Methods describing this use and possible compositions can be found in U.S. Pat. Nos. 6,455,086, 6,313,049, U.S. 2002/0132742, U.S. 2001/0014655, WO99/00025, and U.S. 2002/0151452. In one embodiment, the compositions are safe for use without rinsing on food-contact surfaces. In one embodiment the compositions sanitize or disinfect food-contact surfaces. In one embodiment, the compositions kill 99% of *E. coli* in 2 to 5 min on food-contact surfaces. In one embodiment, the composition leaves less than 20 ppm, or less than 10 ppm or less than 5 ppm or less than 1 ppm organic residue on food-contact surfaces.

In one embodiment, the products can be used as a disinfectant, sanitizer, and/or sterilizer. In one embodiment, the products can be used to remove, denature or inactivate allergens or allergen generating species. As used herein, the term "allergen" refers to "the ability of certain materials to induce specific manifestations of hypersensitivity in man . . . and the associated special antibodies in the serum of such patients are known as reagins." K. Landsteiner, THE SPECIFICITY OF SEROLOGICAL REACTIONS 9 (Dover Publications, NY, rev. ed. 1962), which is hereby incorporated by reference. A reagin is defined as an antibody found in the blood of individuals having a genetic predisposition to allergies. Allergy is the study and treatment of human hypersensitivity reactions producing a pathogenic response to nonself molecules termed allergens. Hypersensitivity (allergic) responses are a type of immune response. Antigens that induce hypersensitivity responses are known as allergens.

Dust mites, house dust, animal dander, animal hair, and the like, represent a mix of substances that contain allergens. Not all substances found in dust mite, house dust, animal dander, animal hair, etc. are capable of inducing an immune response, much less an allergic response. Some of these substances are antigens. They will induce a specific immune response. Some of these antigens are also allergens—they will induce a hypersensitivity response in susceptible individuals. Common allergens present indoors include, but are not limited to, *Dermarophagoides pteronyssinus* and *Dermatophagoides farinae* (both from dust mites), *Felis domesticus* (from cats), *Canis familiaris* (from dogs), *Blatella germanica* (from German cockroach), *Penicillium, Aspergillus* and *Cladosporium* (from fungi), as well as allergens from outdoors that enter the indoor environment, eg., pollen allergens.

As used herein, the term "allergy-related product" refers to products that are marketed to help relieve and/or prevent allergy-related symptoms or control allergens, as well as the source of allergens, such as dust mites. Allergy-related products include, but are not limited to: non-prescription drugs; prescription drugs, especially including, but not limited to, antihistamines, antiinflammatory drugs, glucocorticosteroids, beta-adrenergics and leukotriene modifiers or antagonists; products that control and/or kill the sources of allergens, such as dust mites, including, but not limited to, carpet powders, household sprays, pillowcases, and mattress covers; air filters; HEPA filters; vacuums, especially those with HEPA filters; air purification devices; air pollution monitors; books (especially those relating to the treatment of allergy-related symptoms); face masks for filtering air; water filters (especially those for use in showers and/or bathtubs); household cleaning products, including, but not limited to, hard surface cleaning detergents (especially for floors and countertops), dusting sprays (especially for dusting and/or polishing furniture and household surfaces), and laundry detergents and/or additives capable of controlling and/or killing allergens and the sources thereof, personal cleansing products for either humans and/or animals including, but not limited to, bar soaps, liquid soaps, shampoos, and skin lotions; and the like. As defined herein, the term "allergy-related product" further includes the present cleaning sheets, implements, and articles of manufacture.

In one embodiment, the products can be used on food preparation surfaces and can contain only food-safe ingredients. Compositions for use herein may contain only materials that are food grade or GRAS, including, of course, direct food additives affirmed as GRAS, to protect against possible misuse by the consumer. Failure to rinse thoroughly after cleaning is less of a concern if all of the ingredients are GRAS and/or food grade. In the United States of America, the use and selection of cleaning ingredients for the purpose of washing fruits and vegetables is described by the United States Code of Federal Regulations, Title 21, Section 173. 315: "Ingredients for use in washing or lye peeling of fruits and vegetables". These regulations restrict the ingredients that can be used for direct contact with food to those described as "generally regarded as safe" (GRAS), and a few other selected ingredients. These sections also provide certain limitations on the amount of material that can be used in a given context.

In one embodiment, the present invention encompasses the method of spraying an effective amount of the composition for reducing malodor onto household surfaces. The composition may reduce malodors by chemically destroying or breaking down the malodor or cause of the malodor. The household surfaces can be selected from the group consisting of countertops, cabinets, walls, floors, bathroom surfaces and kitchen surfaces. Other suitable household surfaces include pet areas, pet litter, litter boxes, pet bowls, and pets. The present invention encompasses the method of spraying a mist of an effective amount of the composition for reducing malodor onto fabric and/or fabric articles. The fabric and/or fabric articles can include, but are not limited to, clothes, curtains, drapes, upholstered furniture, carpeting, bed linens, bath linens, tablecloths, sleeping bags, tents, car interior, e.g., car carpet, fabric car seats, etc. The present invention relates to the method of spraying a mist of an effective amount of the composition for reducing malodor impression into the air to absorb malodor. The present invention relates to the method of spraying a mist of an effective amount of the composition for reducing malodor impression onto cat litter, pet bedding and pet houses to absorb malodor. The present invention relates to the method of spraying a mist of an effective amount of the composition for reducing malodor impression onto household pets to absorb malodor.

EXAMPLES

Gas Permeability

Permeability is the process by which mass (gas, liquid, or solid) transfers from one side of a non-porous material, such as a plastic, to the other side. For a compressed gas, the permeation rate for a container is directly proportional to the pressure difference of compressed gas across the container surface, directly proportional to the permeability of the gas in the plastic, directly proportional to the surface area of the container, and inversely proportional to the thickness of the container. In general for most plastics, carbon dioxide permeates 2-5 times faster than oxygen, which permeates 3-6 times faster than nitrogen under the same conditions as shown in Table 1. Permeability will also change as properties of a particular plastic are changed, such as crystallinity and orientation. The high permeability of carbon dioxide for most plastics makes it difficult to maintain sufficient pressure over long storage periods.

TABLE 1

| | Permeability (gram/m × sec) | | |
|---|---|---|---|
| Plastic | Carbon dioxide | Oxygen | Nitrogen |
| Polyethyleneterephthalate | 1.6E−10 | 7.2E−11 | 4.4E−12 |
| Polypropylene | 1.5E−8 | 3.1E−9 | 4.2E−10 |
| Polystyrene | 1.2E−8 | 1.6E−9 | 2.8E−10 |
| Polyvinylchloride | 2.5E−8 | 5.1E−11 | 9.4E−12 |
| Polycarbonate | 1.1E−8 | 2.1E−9 | 2.8E−10 |
| High Density Polyethylene | 7.4E−9 | 1.1E−9 | 2.8E−10 |
| Low Density Polyethylene | 2.0E−8 | 3.2E−9 | 7.9E−10 |

A Mocon® Oxtran 2/60 Oxygen Permeability Instrument, Mocon Testing Service, was be used to test permeability through actual packages. The operating conditions of this test were 1 atm. of pressure for oxygen and 1 to 2 cc volume of DI water. The oxygen transmission rate (cc/package×day) was measured at 23° C. and at 37.8° C. and the results are given in Table 2.

TABLE 2

| | Oxygen transmission rate | |
|---|---|---|
| Container | 23° C. | 37.8° C. |
| 320 ml Polyethylene terephthalate (PET) | 0.153 | 0.263 |
| 350 ml Polyethylene naphthalate (PEN) | 0.026 | 0.050 |

Figure 2:
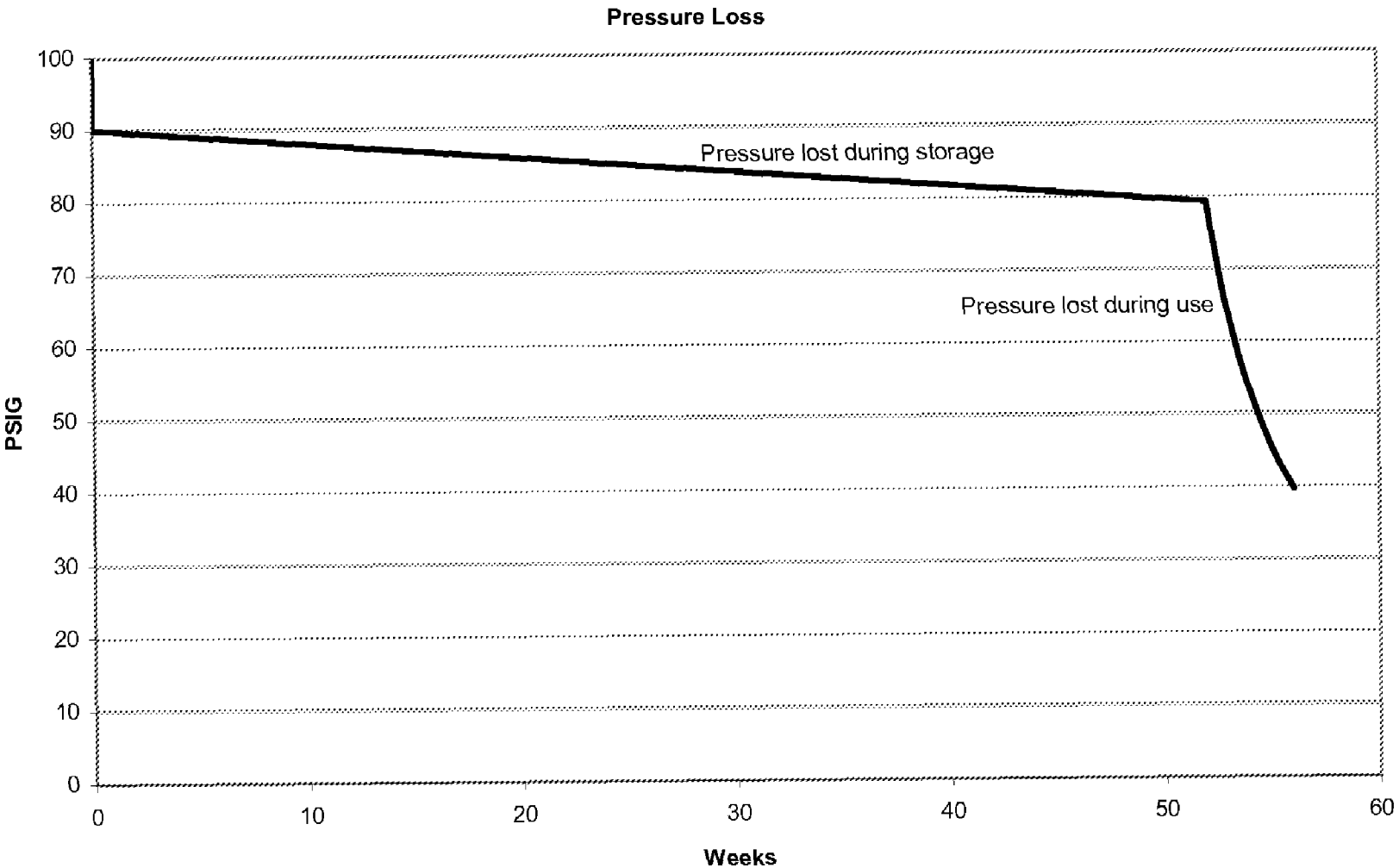
FIG. 2 is a graph of propellant loss over storage and during use.

FIG. 2 shows the loss of nitrogen from a 320 ml PET aerosol container filled to a pressure of 90 psig and a headspace of 50%. The loss of pressure during 52 weeks of storage at 21° C. is about 11 psig. During a normal 3 week product usage period, the loss of pressure drops to about 40 psig as the aerosol composition is expelled. If the permeability of the container to the propellant compressed gas is too high, there will not be sufficient pressure after storage to expel the aerosol composition at a suitable average particle size.

Particle Size

In many aerosol spray applications, it is desirable to deliver a spray of small particles (1-200 microns in diameter) having generally uniform diameters. The actuator or nozzle design also influences aerosol droplet size. Orifice size and taper can be manipulated to tailor droplet size, as well as alter the aerosol spray pattern. Designs that atomize the fluid stream by diverting the propellant within the actuator (so called "mechanical break-up actuators") have also been developed. Such designs form smaller droplets by first inducing a swirling motion of the fluid within the actuator. When the swirling liquid exits the actuator orifice, atomization of the aerosol is enhanced over conventional systems due to the tangential motion of the swirling aerosol formulation.

It is desirable to minimize the particle size of a dispensed product in order to maximize the dispersion of the particles in the air and give a fine mist. A suitable average particle size over at least 75% of the life of the aerosol device is less than 120 μm, or less than 100 μm, or between 40 μm and 120 μm, or between 40 μm and 100 μm. Average particle size, as used herein, means average mean particle size D(V,0.5) of the dispensed product, as measured by a Malvern® Mastersizer Model S Particle Size Analyzer. In addition, the aerosol device can suitably dispense over 98% by weight of the liquid product from the container.

Figure 3:
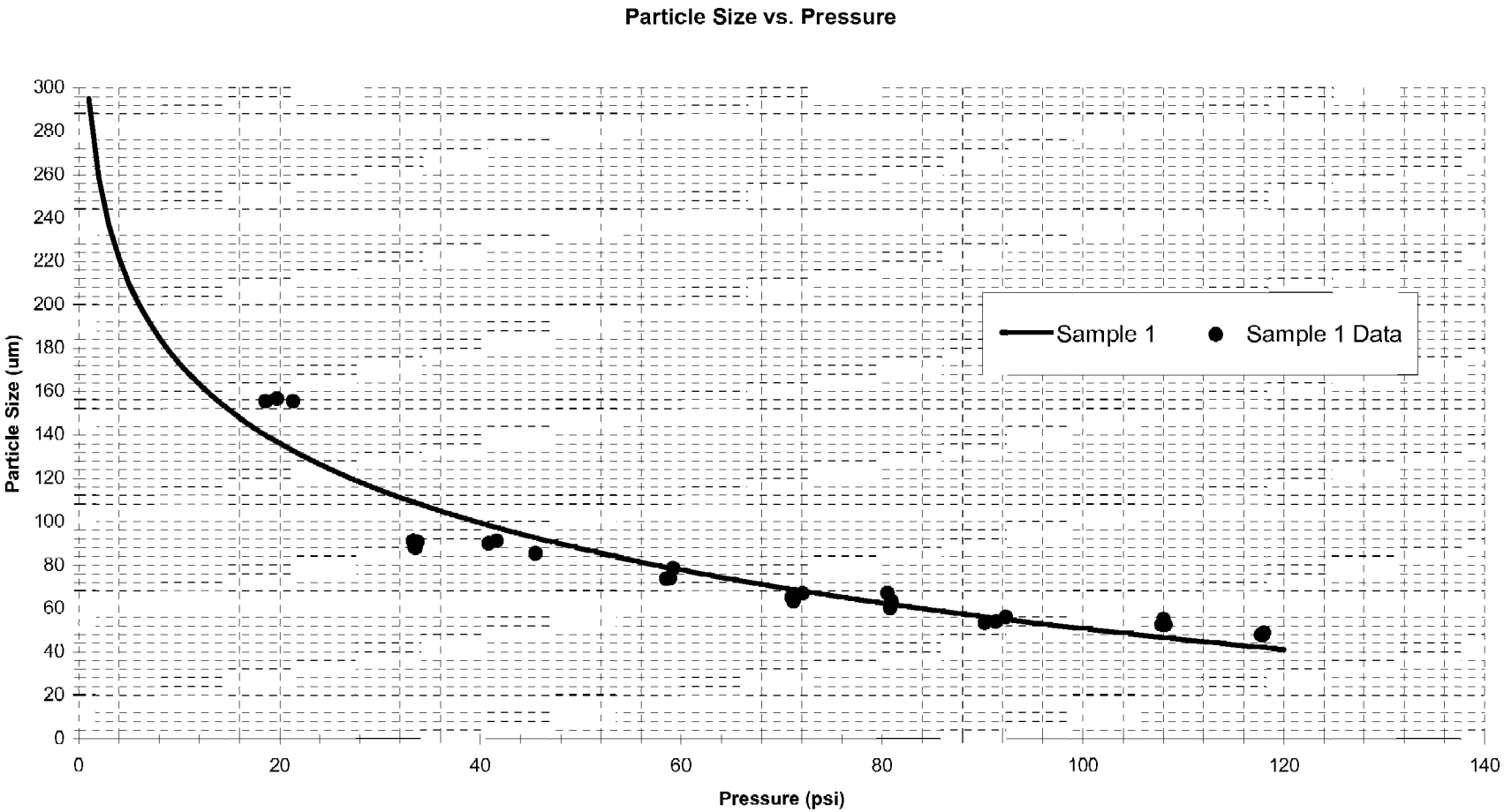
FIG. 3 is a graph of particle size versus pressure.

FIG. 3 shows the average particle size of the spray particles versus the container pressure for an inventive aerosol device. From the graph, the average particle size is less than about 100 μm at 32 psig and less than about 80 μm at 52 psig.

FIG. 3 demonstrates that as the container pressure decreases, the average particle size rapidly increases.

Headspace

Since the compressed gas has limited solubility in the aqueous composition, the compressed gas exists in the headspace of the container above the aqueous composition. The volume to the compressed gas headspace and the volume of the aqueous composition make up 100% of the volume of the container. Suitably, the headspace occupies greater than 40%, or greater than 50%, or greater than 60%, or 20 to 80%, or 30 to 60%, or about 50% of the volume of the container.

Figure 4:
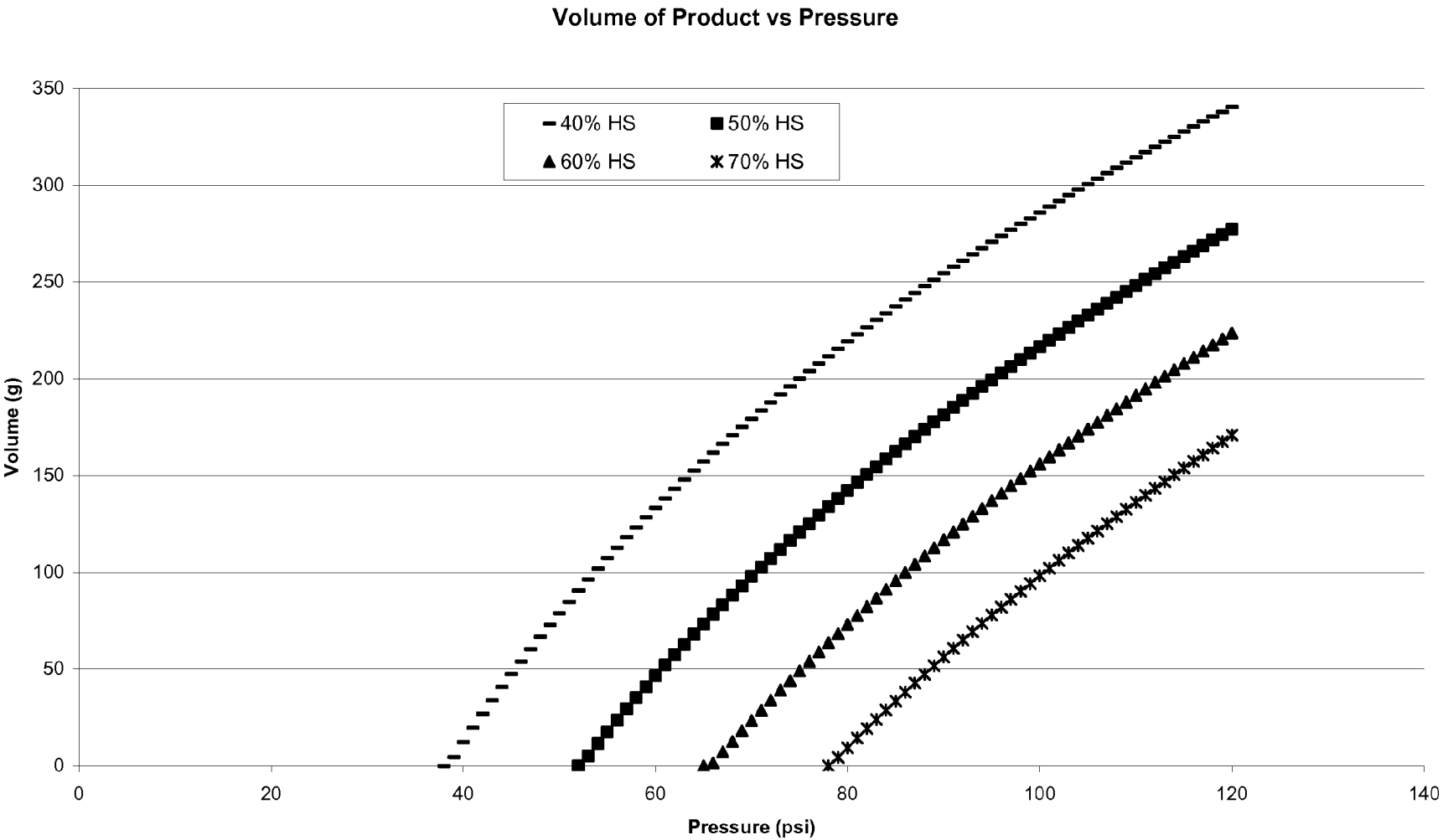
FIG. 4 is a graph of volume of product versus pressure.

FIG. 4 shows the pressure drop for various headspace options of the invention (40% headspace, 50% headspace, 60% headspace, 70% headspace) to deliver a volume of product at a starting and final pressure. For example, the 50% headspace option can deliver 250 ml of product at a starting pressure of about 110 psi and a final pressure of about 50 psi. FIG. 4 demonstrates that in order to deliver all the aerosol composition at a sufficient pressure to ensure adequate average particle size, a significant headspace volume is required.

While this detailed description includes specific examples according to the invention, those skilled in the art will appreciate that there are many variations of these examples that would nevertheless fall within the general scope of the invention and for which protection is sought in the appended claims.

What is claimed is:

1. An aerosol device comprising:

a. a plastic container having an actuator, a valve, and containing an aerosol product composition comprising:
   i. an aqueous composition; and
   ii. a compressed gas propellant selected from the group consisting of oxygen, air, nitrogen and combinations thereof;

b. wherein the container has an oxygen transfer rate of less than 0.2 cc/(package*day) at 23° C;

c. wherein the container has an initial headspace of greater than 50%;

d. wherein the aerosol spray has an initial average particle size of greater than 40 μm and less than 100 μm; and e. wherein the container has an initial pressure of greater than 75 psi.

2. An aerosol device comprising:

a. a plastic container having an actuator, a valve, and containing an aerosol product composition comprising:
   i. an aqueous composition; and
   ii. a compressed gas propellant selected from the group consisting of oxygen, air, nitrogen and combinations thereof;

b. wherein the plastic container comprises a plastic from the group consisting of physical PET/PEN resin blends, polyethylene naphthalene (PEN) copolymers, or PEN homopolymers;

c. wherein the container has an initial headspace of greater than 40%; and d. wherein the aerosol spray has an initial average particle size of less than 100 μm.

3. The aerosol device of claim 2; wherein the compressed gas propellant comprises oxygen.

4. The aerosol device of claim 2; wherein the compressed gas propellant comprises nitrogen.

5. The aerosol device of claim 2; wherein the compressed gas propellant comprises air.

6. The aerosol device of claim 2; wherein the container has an initial headspace of greater than 50%.

7. The aerosol device of claim 2; wherein the container has an initial headspace of greater than 60%.

8. The aerosol device of claim 2; wherein the aerosol spray has an initial average particle size of less than 80 μm.

9. The aerosol device of claim 2; wherein the aerosol spray has an initial average particle size of greater than 40 μm and less than 80 μm.

10. The aerosol device of claim 2, wherein the container volume is greater than 4 oz.

11. The aerosol device of claim 2, wherein the container volume is greater than 10 oz.

12. The aerosol device of claim 2, wherein the container has an oxygen transfer rate of less than 0.2 cc/(package*day) at 23° C.

13. The aerosol device of claim 2, wherein the aqueous composition comprises a bleach.

14. The aerosol device of claim 13, wherein the bleach comprises hypochlorite.

15. The aerosol device of claim 2, wherein the container has an initial pressure of greater than 75 psi.

16. The aerosol device of claim 2, wherein the aerosol product composition can be used as a disinfectant, and/or sterilizer.

17. The aerosol device of claim 2, wherein the aerosol product composition can be used to remove, denature or inactivate allergens or allergen generating species.

18. The aerosol device of claim 2, wherein the aerosol product composition can be used on food preparation surfaces.

* * * * *